US006654969B2

(12) United States Patent
Taniuchi

(10) Patent No.: US 6,654,969 B2
(45) Date of Patent: Dec. 2, 2003

(54) SYSTEM FOR CONTROLLING SHIELD PLATE FOR HELMET

(75) Inventor: Fujio Taniuchi, Tokyo (JP)

(73) Assignee: Kabushiki Kaisha Shoei, Tokyo (JP)

( * ) Notice: Subject to any disclaimer, the term of this patent is extended or adjusted under 35 U.S.C. 154(b) by 0 days.

(21) Appl. No.: 10/146,664

(22) Filed: May 15, 2002

(65) Prior Publication Data

US 2002/0189005 A1 Dec. 19, 2002

(30) Foreign Application Priority Data

May 18, 2001 (JP) ..... 2001-149630

(51) Int. Cl.[7] ..... A42B 1/08
(52) U.S. Cl. ..... 2/424
(58) Field of Search ..... 2/410, 424, 425, 2/422, 10, 12

(56) References Cited

U.S. PATENT DOCUMENTS 4,907,299 A * 3/1990 Arai ..... 2/424
5,165,117 A * 11/1992 Kamata ..... 2/424
5,185,889 A * 2/1993 Kamata ..... 2/424
5,461,731 A * 10/1995 Shida ..... 2/424

FOREIGN PATENT DOCUMENTS

JP 05-214604 8/1993

* cited by examiner

*Primary Examiner*—Rodney M. Lindsey
(74) *Attorney, Agent, or Firm*—Carrier, Blackman & Associates, P.C.; Joseph P. Carrier; William D. Blackman

(57) ABSTRACT

A system for controlling a shield plate in a helmet includes a shield plate 4 pivotally supported on a cap body 2, and a control lever 52 capable of being turned between a neutral position N in which the full closing of the cap body is permitted, and a slightly opening position A in which the shield plate in the fully closed position is pushed up and opened at a very small opening degree. In this system, the control lever 52 has a locking position permitting the control lever to turn from the neutral position in a direction opposite from the slightly opening position A. The shield plate has an abutment projection 61 formed on its inner surface, while the control lever 52 has a locking claw 52*d* adapted to be put into abutment against a front surface of the abutment projection 61 to inhibit the opening of the shield plate 4 upon turning the control lever 52 to a locking position B when the shield plate is in the fully closed position. Thus, the restraint of the shield plate in the fully closed position and the release thereof can be carried out properly over a long term without provision of portions rubbing each other.

3 Claims, 15 Drawing Sheets

CONTROL LEVER IN NEUTRAL POSITION

CONTROL LEVER IN SLIGHTLY OPENING POSITION

CONTROL LEVER IN LOCKING POSITION

SYSTEM FOR CONTROLLING SHIELD PLATE FOR HELMET

BACKGROUND OF THE INVENTION

1. Field of the Invention

The present invention relates to a system for controlling a shield plate in a helmet adapted to be put mainly on a vehicle rider, which comprises a click stop mechanism mounted between a cap body and a shield plate pivotally supported on the cap body, the mechanism being capable of retaining the shield plate in any of a fully closed position, a fully opened position and a plurality of intermediate opened positions, and a control lever pivotally supported on the cap body and capable of being turned between a neutral position in which the fully closing of the cap body is permitted, and a slightly opening position in which the shield plate in the fully closed position is pushed up and opened at a very small opening degree. More particularly, the present invention relates to an improvement in such a system controlling a shield plate in a helmet, including a locking means capable of restraining the shield plate in the fully closed position.

2. Description of the Related Art

A conventional shield plate controlling system in a helmet includes a locking means capable of restraining the shield plate in the fully closed position is already known as disclosed, for example, in Japanese Patent Application Laid-open No. 5-214604.

In the above conventional system, a locking bore is defined in an inner surface of the shield plate, and a locking pin is fixedly provided on the cap body adapted to be brought into engagement in the locking bore to lock the shield plate in the fully closed position. When the control lever is turned from the neutral position to the slightly opening position, the shield plate is pushed up from the inside by a cam formed on the control lever, whereby the locking bore in the locked shield plate is disengaged from the locking pin on the cap body. In such system, whenever the control lever is turned from the neutral position to the slightly opening position to disengage the locking bore in the locked shield plate from the locking pin of the cap body, the cam rubs the inner surface of the shield plate strongly. For this reason, when rubbing portions of the cam and the shield plate are worn during long term use of the control lever, there is a possibility that it is difficult to disengage the locking bore from the locking pin.

SUMMARY OF THE INVENTION

Accordingly, it is an object of the present invention to provide a system for controlling a shield plate in a helmet, wherein the restraint of the shield plate in the fully closed position and the release of the restraint can be carried out properly over a long term, utilizing the control lever, without provision of portions rubbing each other strongly.

To achieve the above object, according to a first aspect and feature of the present invention, there is provided a system for controlling a shield plate in a helmet, comprising a click stop mechanism mounted between a cap body and a shield plate pivotally supported on the cap body, the mechanism being capable of retaining the shield plate in a fully closed position, a fully opened position and a plurality of intermediate opened positions; and a control lever pivotally supported on the cap body and capable of being turned between a neutral position in which the full closing of the cap body is permitted, and a slightly opening position in which the shield plate in the fully closed position is pushed up and opened at a very small opening degree; wherein the control lever has a locking position permitting the control lever to turn from the neutral position in a direction opposite from the slightly opening position; wherein shield plate has an abutment projection formed on its inner surface; and wherein the control lever has a locking claw adapted to be put into abutment against a front surface of the abutment projection to inhibit the opening of the shield plate upon turning the control lever to the locking position when the shield plate is in the fully closed position.

With the arrangement of the first feature, when the control lever is set in the locking position after bringing the shield plate into the fully closed state, the locking claw of the control lever can be put into abutment against the front projection on the inner surface of the shield plate, to restrain the shield plate in the fully closed state. Moreover, when the shield plate is restrained or released from the restraint by the operation of the control lever, the abutment projection and the locking claw are merely put into abutment against each other and never rub each other. Therefore, the abutment projection and the locking claw are not worn due to the use of the control lever for a long term and hence, the restraint of the shield plate and the release thereof can be always carried out properly.

According to a second aspect and feature of the present invention, in addition to the first feature, the locking claw has a slant formed thereon so that when the control lever is in the locking position, if the shield plate is turned from an opened position to the fully closed position, the slant is pushed by the abutment projection to turn the control lever to the neutral position.

With the arrangement of the second feature, even when the control lever is first set in the locking position and the shield plate is then turned to the fully closed position, the abutment projection can push the slant at the upper portion of the locking claw to return the control lever to the neutral position. Therefore, the shield plate can be brought reliably into the fully closed state without being obstructed by the locking claw.

According to a third aspect and feature of the present invention, in addition to the first or second feature, the abutment projection is integrally connected to a toothed wall of the click stop mechanism, the toothed wall having click teeth formed on the inner surface of the shield plate.

With the arrangement of the third feature, the abutment projection is reinforced effectively by the relatively large toothed wall, whereby the restraint strength of the shield plate restrained in the fully closed state can be enhanced.

The above and other objects, features and advantages of the invention will become apparent from the following description of the preferred embodiment taken in conjunction with the accompanying drawings.

DESCRIPTION OF THE PREFERRED EMBODIMENT

The present invention will now be described by way of an embodiment with reference to the accompanying drawings.

Figure 1:
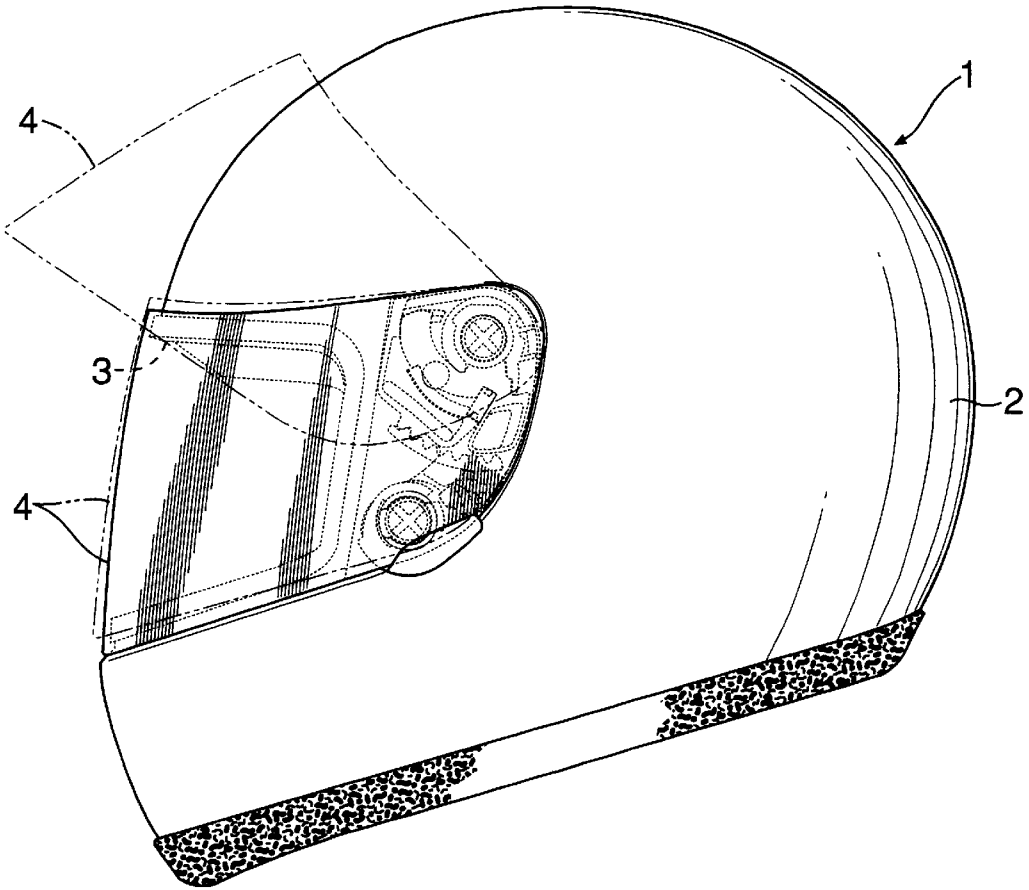
FIG. 1 is a side view of a helmet including a shield plate controlling system according to the present invention.

Referring first to FIG. 1, reference numeral 1 denotes a full-face-type helmet for a motorcycle rider. A shield plate 4 is vertically turnably mounted at its left and right ends on left and right sidewalls of a cap body 2, and adapted open and close a window 3 which opens in a front wall of the cap body 2. The shield plate 4 is formed, over its entire region including its opposite ends, by a translucent or semi-translucent synthetic resin as a starting material.

Figure 2:
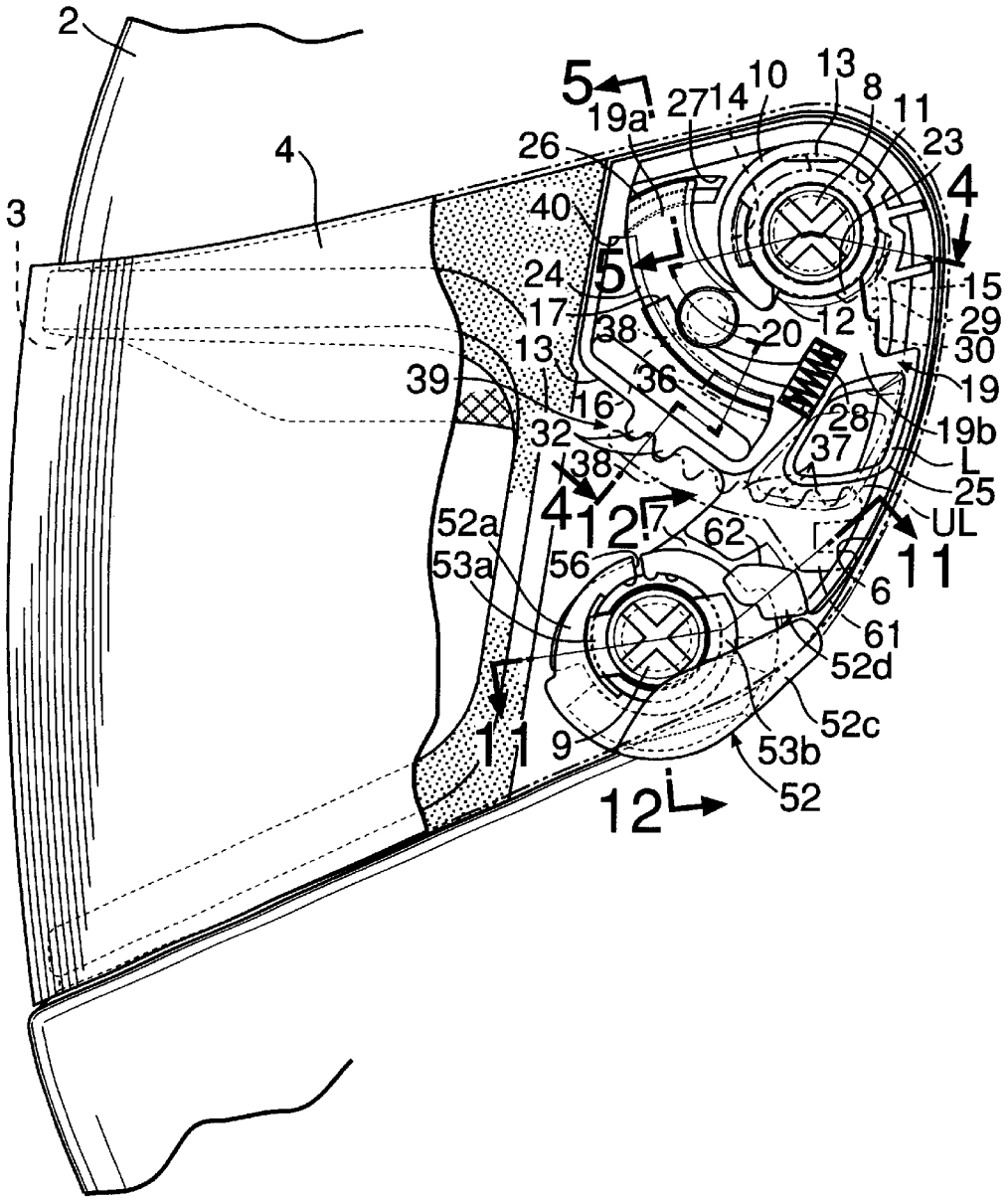
FIG. 2 is a partially cutaway enlarged sectional view taken from FIG. 1.
Figure 3:
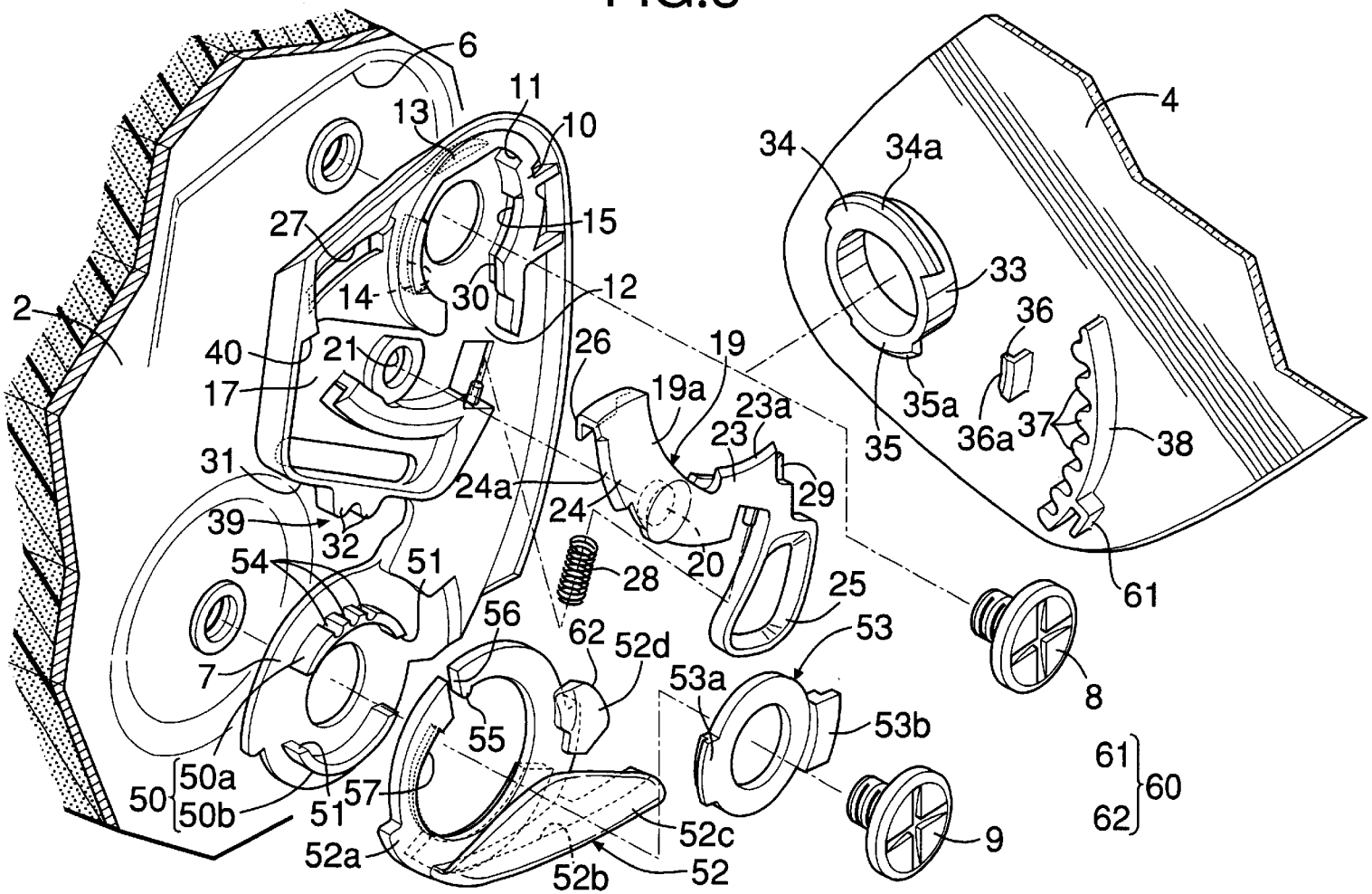
FIG. 3 is an exploded perspective view of essential portions of the helmet.
Figure 4:
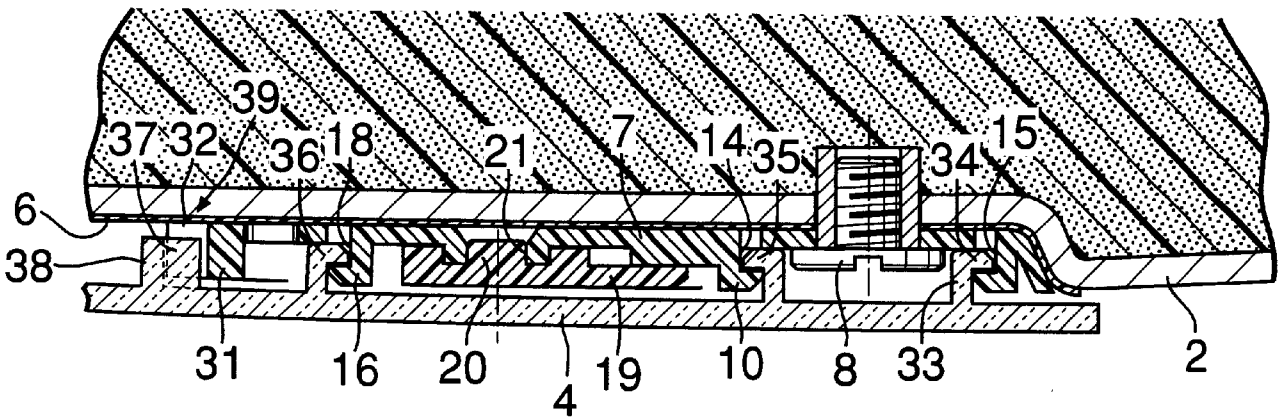
FIG. 4 is a sectional view taken along a line 4—4 in FIG. 2.
Figure 5:
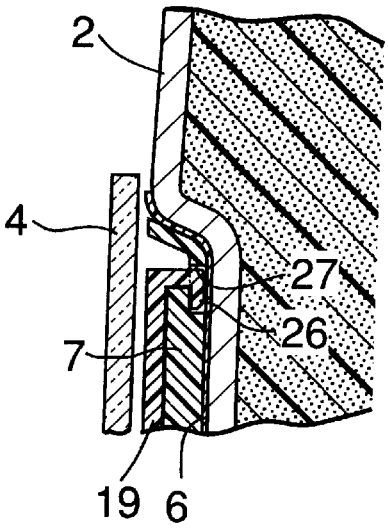
FIG. 5 is a sectional view taken along a line 5—5 in FIG. 2.

As shown in FIGS. 2 and 3, a shallow recess 6 is defined in each of left and right outer surfaces of the cap body 2, and a bracket plate 7 made of a synthetic resin is secured to a bottom surface of the recess 6 at two upper and lower points by screws 8 and 9.

Figure 7:
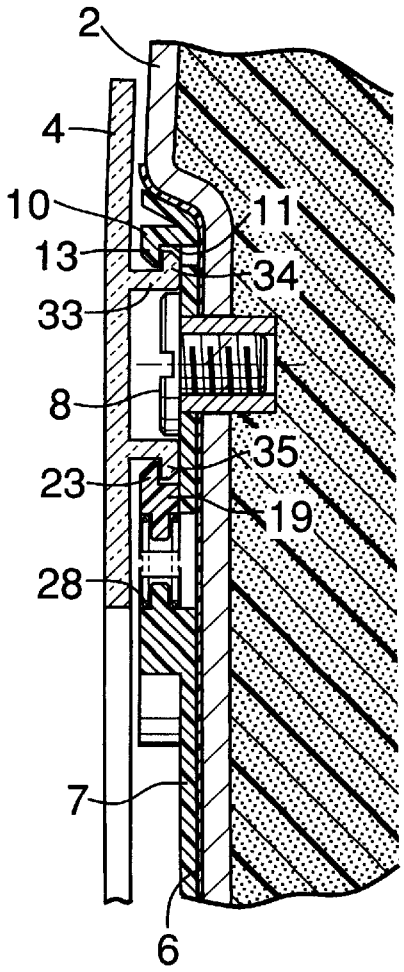
FIG. 7 is a sectional view taken along a line 7—7 in FIG. 6.

As shown in FIGS. 2 to 5, a support tube 10 is integrally formed on a surface of the bracket plate 7 to surround the upper screw 8. A wide fan-shaped recess 11 is provided in an upper portion of an inner wall of the support tube 10, and a narrower notch 12 is provided in a lower portion of the support tube 10. A visor-shaped temporarily fixing projection 13 (see FIGS. 3 and 7) is formed at an upper edge of a central portion of the fan-shaped recess 11. Further, provided in the inner wall of the support tube 10 are a guide groove 14 extending downwards from a front end of the fan-shaped recess 11, and a guide groove 15 extending upwards from a rear end of the notch 12.

The bracket plate 7 has a protruding guide wall 16 formed therein and having an arcuate shape concentric with the support tube 10 so that the guide wall 16 is forwardly spaced away from the support tube 10 and downwards, and a notch 17 is provided at an upper portion of the protruding guide wall 16. The protruding guide wall 16 also has a locking groove 18 provided in its outer peripheral surface.

A locking lever 19 is disposed between the support tube 10 and the protruding guide wall 16, and a support shaft 20 integral with the lever 19 is rotatably fitted into a shaft bore 21 provided in the bracket plate 7 between both of the notches 12 and 17.

The locking lever 19 is of a bow-shape including an upper arm 19*a* extending upwards from the support shaft 20, and a lower arm 19*b* extending downwards and rearwards from the same. A first locking claw 23 is provided on the lower arm 19*b* for movement into and out of the notch 12 in the support tube 10, and a second locking claw 24 is provided on the upper arm 19*a* for movement into and out of the notch 17 in the protruding guide wall 16. The first and second locking claws 23 and 24 are provided at their tip ends with outer edges formed as slants 23*a* and 24*a* (FIG. 3), respectively.

A ring-shaped knob 25 is formed at a tip end of the lower arm 19*b*, and a guide claw 26 is formed at a tip end of the upper arm 19*a*.

Figure 9:
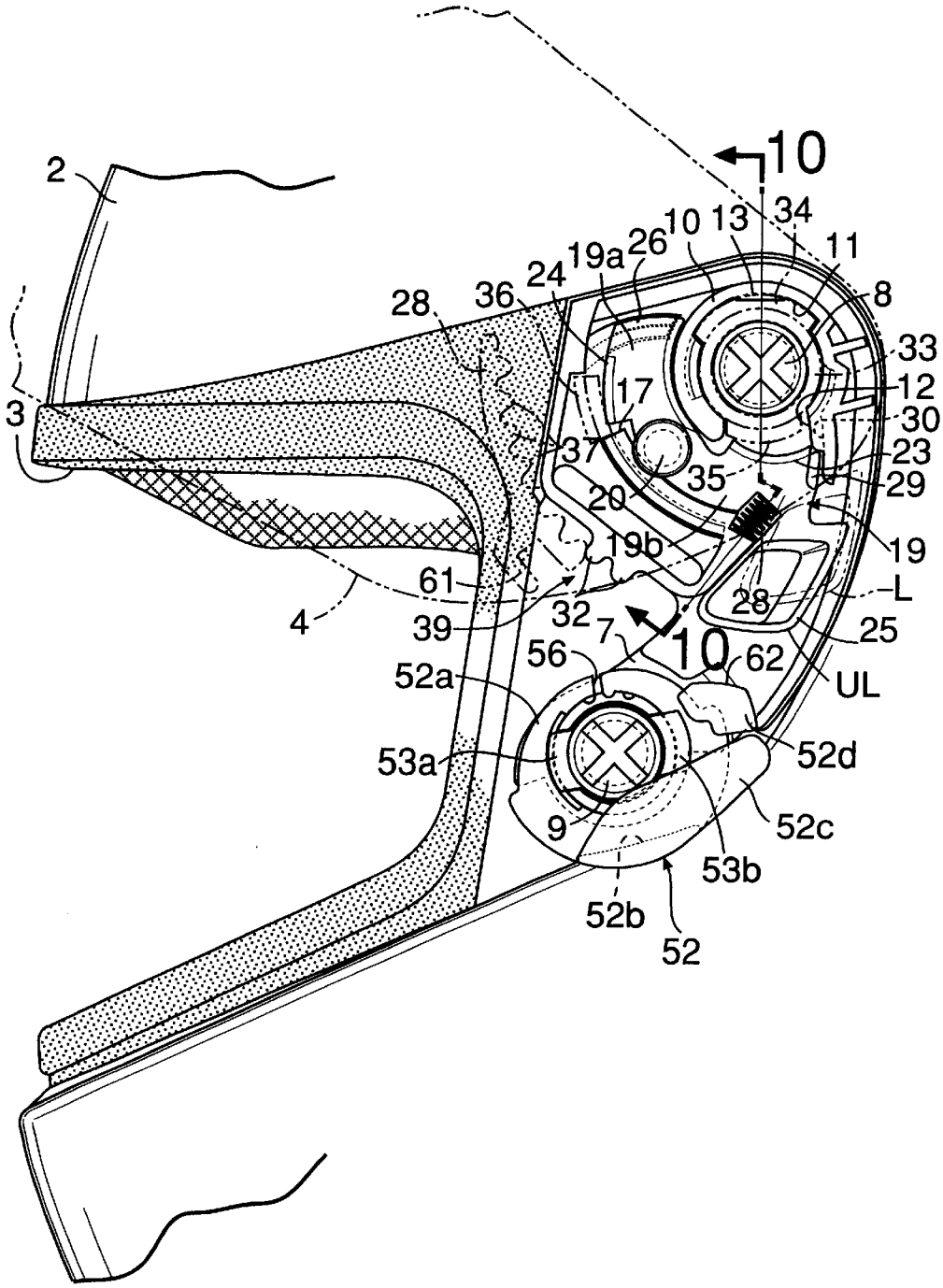
FIG. 9 is an enlarged side view of essential portions of the helmet for explaining how to remove the shield plate.

The guide claw 26 is arcuate about the support shaft 20 and adapted to be brought into engagement (see FIG. 5) in the guide bore 27 provided in the bracket plate 7 and having an arcuate shape about the shaft bore 21, thereby preventing the disengagement of the locking lever 19 from the bracket plate 7. The guide claw 26 is also adapted to be put into abutment against one end wall and the other end wall of the guide bore 27 to define a locking position L and an unlocking position $U_L$ of the locking lever 19. Thus, in the locking position L (see FIG. 6) of the locking lever 19, the first and second locking claws 23 and 24 enter the notches 12 and 17, respectively, and in the unlocking position $U_L$ (see FIG. 9), the first and second locking claws 23 and 24 retreat from the notches 12 and 17, respectively.

A locking spring 28 (see FIG. 7) is mounted under compression between the bracket plate 7 and the locking lever 19 for biasing the lever 19 toward the locking position L.

Further, to prevent the disengagement of the locking lever 19, the lever 19 and the support tube 10 are provided with a projection 29 and a recess 30 (see FIG. 3) which are in engagement with each other when the lever 19 is in the locking position L.

Further, a resilient arm 31 is integrally coupled at its opposite ends to the bracket plate 7 in front of the protruding guide wall 16. The resilient arm 31 has a single or a plurality of stationary click teeth 32 on a front surface of a central portion thereof.

On the other hand, a pivot 33 is integrally provided in a projecting manner on an inner face of each of left and right ends of the shield plate 4, so that it is loosely fitted into the support tube 10. Locking claws 34 and 35 are formed on an outer periphery of the pivot 33 and capable of being brought into engagement in the guide grooves 14 and 15 through the fan-shaped recess 11 and the notch 12, respectively. Outer peripheral edges of the locking claws 34 and 35 are slants 34*a* and 35*a* (see FIG. 3) capable of being brought into sliding contact with the temporarily locking projection 13 and the slant 23*a* of the first locking claw 23, respectively.

A locking claw 36 is formed on the inner surface of each of the left and right ends of the shield plate 4 and capable of being brought into engagement in the guide groove 18 through the notch 17 in the protruding guide wall 16, and a slant 36*a* (see FIG. 3) is also formed on one side of a tip end of the locking claw 36 and capable of being brought into sliding contact with the slant 24*a* of the second locking claw 24.

Further, a toothed wall 38 is integrally formed on the shield plate 4 and has a large number of click teeth 37 projectingly provided on its inner peripheral surface so that they are brought into engagement with the stationary click teeth 32 with a resilient force of the resilient arm 31. The toothed wall 38 is arcuate about the pivot 33. Thus, the resilient arm 31 and the toothed wall 38 constitute a click stop mechanism 39 for stopping the shield plate 4 at any of a plurality of turned positions.

The shield plate 4 has a fully opened position, which is defined by abutment of the locking claw 36 against an upper end wall, i.e., a stopper wall 40 of the notch 17. This fully opened position is an attaching/detaching position of the shield plate 4, in which the locking claw 34 is matched with the fan-shaped recess 11; the locking claw 35 is matched with the notch 12, and the locking claw 36 is matched with the notch 17.

Figure 6:
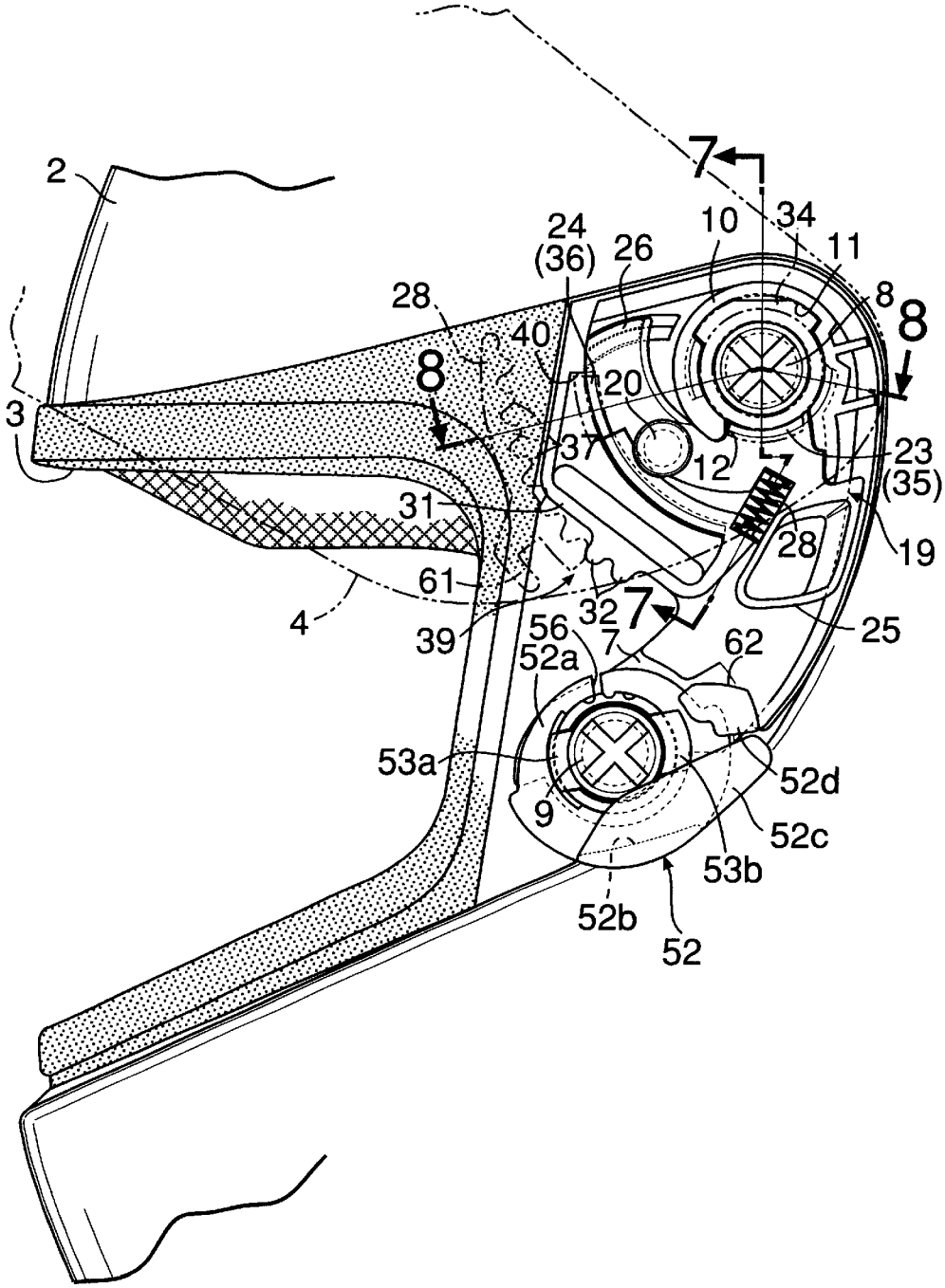
FIG. 6 is an enlarged side view of essential portions of the helmet in a fully closed state of the shield plate.

To attach the shield plate 4 to the cap body 2, the pivot 33 of the shield plate 4 is aligned with the support tube 10 of the bracket plate 7 in the fully opened position of the shield plate 4, as shown in FIG. 6, so that the locking claws 34 and 35 of the pivot 33 are brought into positions in which they can enter the fan-shaped recess 11 and the notch 12 in the support tube 10, respectively, and the other locking claw 36 is brought into a position in which it can enter the notch 17 in the protruding guide wall 16.

Figure 8:
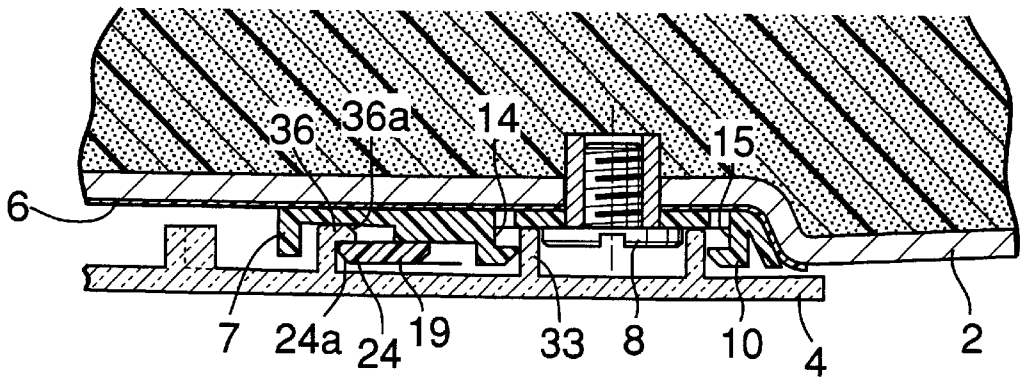
FIG. 8 is a sectional view taken along a line 8—8 in FIG. 6.
Figure 10:
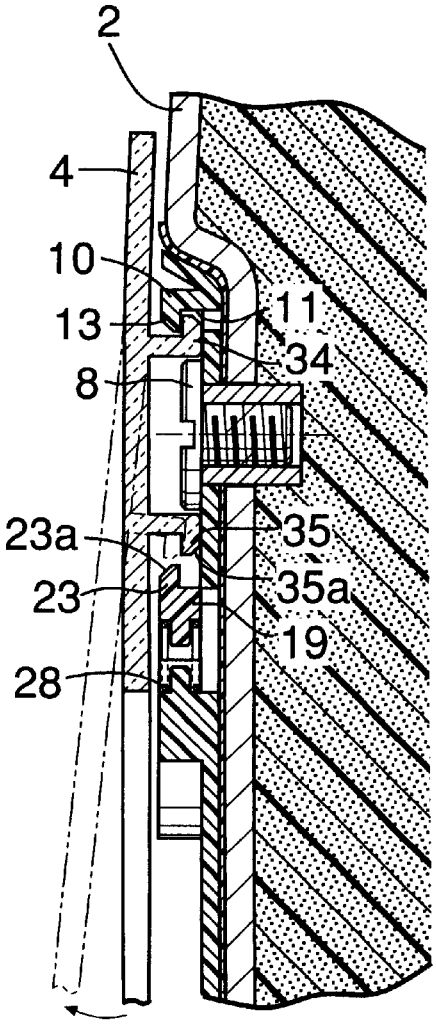
FIG. 10 is a sectional view taken along a line 10—10 in FIG. 9.
Figure 11:
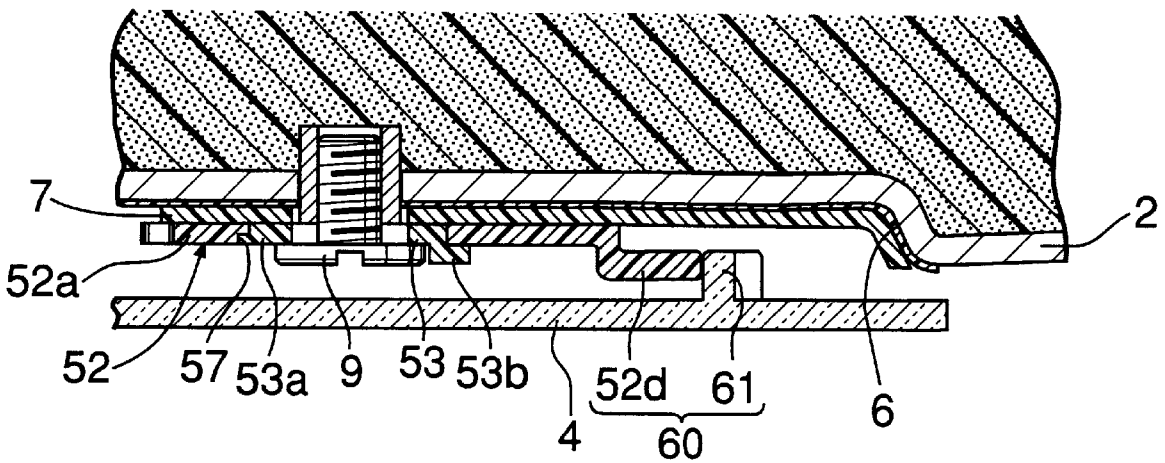
FIG. 11 is a sectional view taken along a line 11—11 in FIG. 2.
Figure 12:
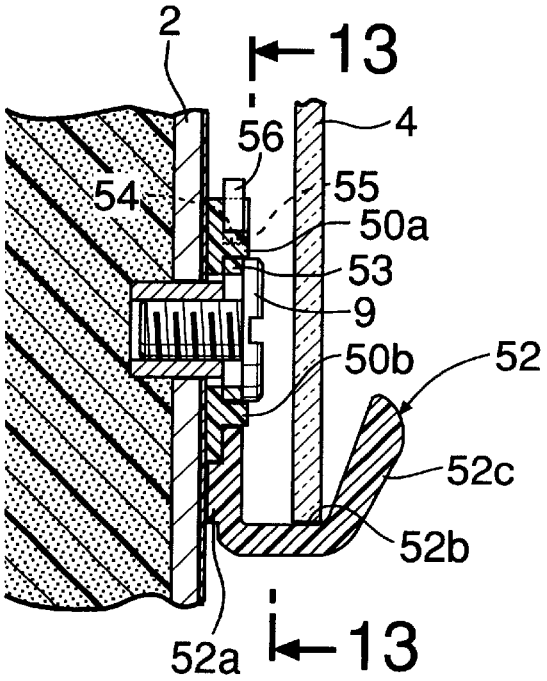
FIG. 12 is a sectional view taken along a line 12—12 in FIG. 2.

Thereupon, the locking claw 34 is first put into the fan-shaped recess 11 of the support tube 10, while being sunk below the temporarily locking projection 13 by grasping the end of the shield plate 4 lightly (see a state shown in FIG. 10). Then, when the end of the shield plate 4 is pushed strongly toward the bracket plate 7, the locking claw 35 enter the notch in the support tube 10, while temporally pushing away the slant 23*a* of the first locking claw 23 of the locking lever 19 by the slant 35*a* of the clocking claw 35, and the remaining locking claw 36 also enters the notch 17 in the protruding guide wall 16, with the slant 24*a* of the second locking claw 24 being temporally pushed away by the slant 36*a* of the locking claw 36. Therefore, the locking lever 19 is pushed toward the unlocking position $U_L$, so that the locking claws 35 and 36 are temporally retracted from the notches 12 and 17 corresponding to the first and second locking claws 23 and 24. However, when the locking claws 35 and 36 enter the notches 12 and 17, respectively, the locking lever 19 is returned immediately to the original locking position L by the resilient force of the locking spring 28, whereby the first and second locking claws 23 and 24 are brought into engagement with the locking claws 35 and 36 (see FIGS. 7 and 8). This engaged state cannot be released, unless the locking lever 19 is turned to the unlocking position $U_L$.

When the shield plate 4 has been attached to the cap body 2 in the above manner, upper one of the stationary click teeth 32 and lowermost one of the movable click teeth 37 in the click stop mechanism 39 are brought into engagement with each other by the resilient force of the resilient arm 31 to provide an operative state. Thereupon, when the shield plate 4 is turned downwards around the pivot 33, the engaged positions of the three locking claws 34, 35 and 36 of the shield plate 4 are shifted to the three guide grooves 14, 15 and 18 in the bracket plate 7. Therefore, the states of the locking claws 34, 35 and 36 coupled to the bracket plate 7 are ensured further reliably.

On the other hand, in the click stop mechanism 39, whenever the shield plate 4 is turned through a predetermined unit angle, the position of engagement of the stationary and movable click teeth 32 and 37 with each other can be changed, while flexing the resilient arm 31 to provide a moderation, and the shield plate 4 can be retained in its turned position.

In this case, particularly, the resilient arm 31 having the stationary teeth 32 at its central portion is connected at its opposite ends to the bracket plate 7, namely, is supported in a straddling manner. Therefore, when the direction of turning movement of the shield plate 4 is changed to an upward direction or a downward direction, even if a point of pushing of the movable clock tooth 37 to the stationary click tooth 32 is shifted from one side of the tooth to the other side, a change is not caused in total length from the pushing point to the opposite ends of the resilient arm 31. Thus, the resistance of the resilient arm 31 against flexing is also not changed and hence, constant moderation can be always provided.

Referring to FIGS. 2, 3 and 11 to 13, a support tube 50 is integrally provided in a projecting manner on one side of the cap body 2, desirably on the outer surface of the left bracket 7, to surround the screw 9. The support tube 50 is divided into a pair of upper and lower support tube walls 50*a* and 50*b* by notches 51, 51 extending along a diametrical line on the support tube 50. An annular boss 52*a* of a control lever 52 made of a synthetic resin is rotatably fitted over an outer periphery of the support tube 50, and a retaining plate 53 is secured to the cap body 2 along with the bracket plate 7 by the screw 9, and has a pair of collars 53*a* and 53*b* opposed to an upper surface of the annular boss 52*a*, while being in engagement in the notches 51, 51. Therefore, the state of the annular boss 52*a* fitted over the support tube 50 is retained by the retaining plate 53. The screw 9 and the annular boss 52*a* are adapted to be covered with the shield plate occupying a fully closed position.

The control lever 52 includes a cam 52*b* connected to a lower end of the annular boss 52*a* and opposed to the lower end edge of the shield plate 4, and a knob 52*c* extending outwards of the shield plate 4 and rearwards of the support tube 50 from the cam 52*b*, so that the control lever 52 is turned about a neutral position N (see FIG. 13) forwards to a slightly opening position A (see FIG. 14) and rearwards to a locking position B (see FIG. 15) by the knob 52*c*.

Three click notches 54 are defined at equal distances in a circumferential direction in an outer peripheral surface of the upper support tube wall 50*a* in correspondence to the three positions N, A and B, so that the control lever 52 can be retained in any of the three positions N, A and B. On the other hand, a click projection 55 is formed on an inner peripheral surface of the annular boss 52*a*, so that it can be selectively brought into engagement in any of the click notches 54.

A single gap 56 is provided in the annular boss 52*a* to provide a radial resilience to the annular boss 52*a*, so that the click projection 55 can be resiliently brought into engagement in any of the click notches 54.

Further, an arcuate recess 57 is defined in the inner peripheral surface of the annular boss 52*a* and adapted to be brought into engagement with one of the collars 53*a* of the retaining plate 53, so that the maximum angle of rotation from the locking position B to the slightly opening position A of the control lever 52 is defined by abutment of the collar 53*a* against circumferentially opposite end walls of the recess 57.

When the control lever 52 is set in the neutral position N, it permits the full closing of the shield plate 4. When the control lever 52 is turned from the neutral position N to the slightly opening position A, the cam 52*b* pushes the lower end edge of the shield plate 4 slightly upwards to provide a very small opening degree to the shield plate 4. The very small opening degree of the shield plate 4 at that time is set smaller than a unit opening degree of the shield plate 4 defined by the click stop mechanism 39.

A locking means 60 is mounted between the control lever 52 and the shield plate 4 and adapted to restrain the shield plate 4 in the fully closed position, when the control lever 52 is set in the locking position B. The locking means 60 is comprised of an abutment projection 61 formed on the inner surface of the shield plate 4 integrally with the toothed wall 38 of the click stop mechanism 39, and a locking claw 52*d* projectingly provided at a rear portion of the annular boss 52*a*. When the shield plate 4 is in the fully closed state, if the control lever 52 is turned to the locking position B, the locking claw 52*d* is put into abutment against a front surface of the abutment projection 61 to restrain the shield plate 4 in the fully closed position.

A slant 62 is formed at an upper portion of the locking claw 52*d*, so that when the shield plate 4 is fully closed after the control lever 52 is first set in the locking position B, the abutment projection 61 pushes the slant 62 to return the control lever 62 to the neutral position N.

The operation of the present embodiment will be described below.

Figure 13:
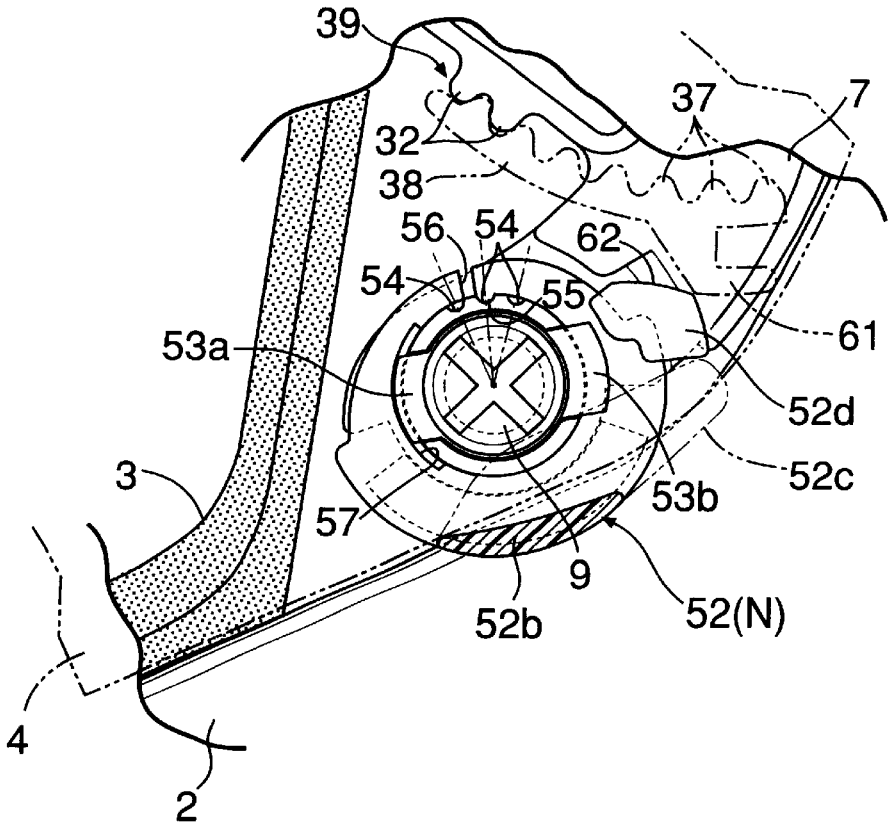
FIG. 13 is a sectional view taken along a line 13—13 in FIG. 12 and showing a control lever in an inoperated state.

In a state in which the control lever 52 has been set in the neutral position N, the locking claw 52*d* of the control lever 52 is out of a path of turning movement of the abutment projection 61 of the shield plate 4, a shown in FIG. 13. Therefore, it is possible for an operator to put his finger or fingers on the lower end edge of the shield plate 4 to turn the shield plate 4 from the fully closed position to a desired opening degree without being interfered by the locking claw 52*d*.

Figure 14:
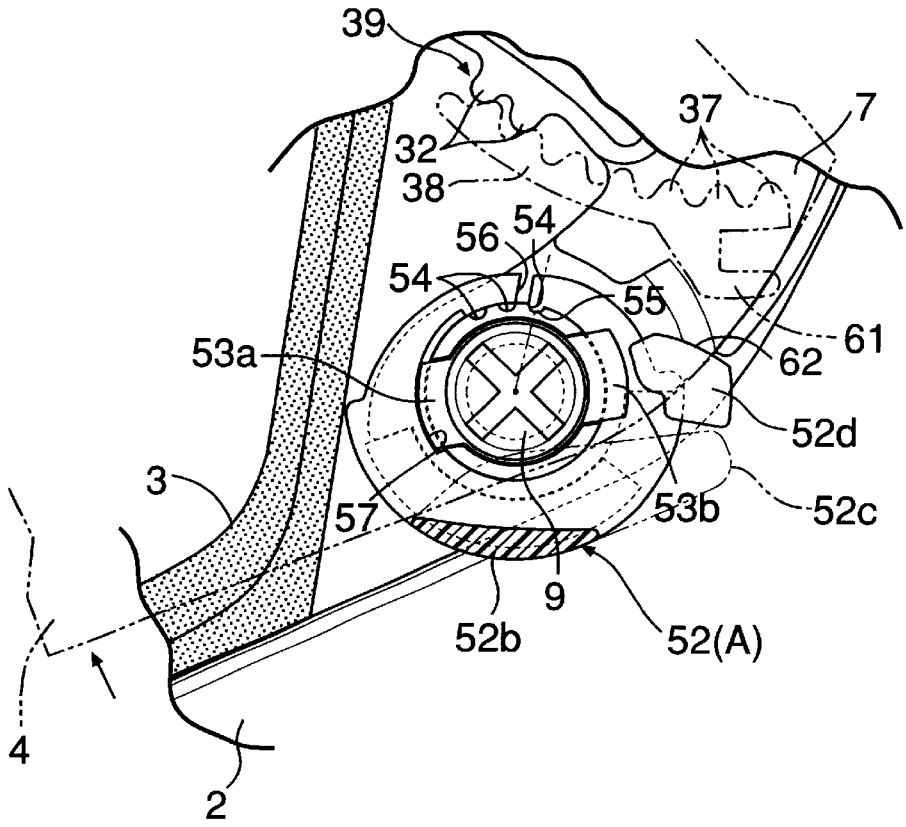
FIG. 14 is a view similar to FIG. 13, but showing the shield plate brought into a slightly opened state by the control lever.

When the shield plate 4 is in the fully closed position, if the control lever 52 is turned from the neutral position N to the slightly opening position A, as shown in FIG. 14, the cam 52*b* can push the shield plate 4 to open it to the very small opening degree smaller than the unit opening degree of the shield plate 4 defined by the click stop mechanism 39. Thus, travel wind can be supplied in a small amount to the window 3 from below the shield plate 4 to ventilate the cap body 2 moderately.

Figure 15:
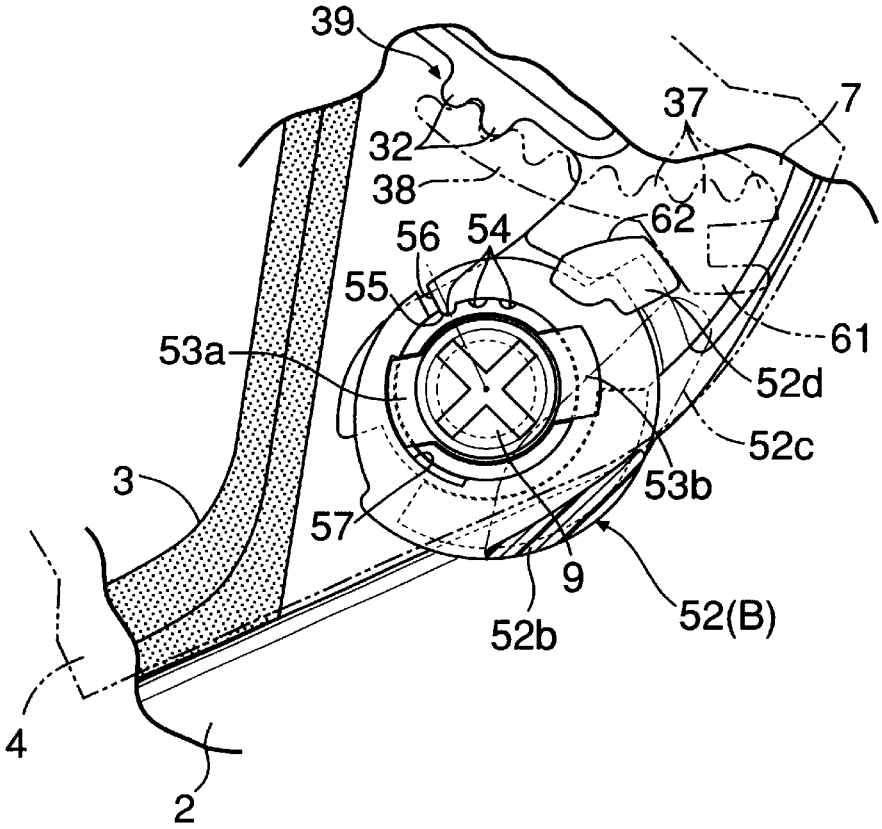
FIG. 15 is a view similar to FIG. 13, but showing the shield plate brought into a fully closed state by the control lever.

When the control lever 52 is set in the locking position B after bringing the shield plate 4 into the fully closed state, as shown in FIG. 15, the locking claw 52*d* of the control lever 52 is put into abutment against the front surface of the abutment projection 61 on the inner surface of the shield plate 4 to inhibit the opening of the shield plate 4. Therefore, even if the helmet is subjected to a strong wind or a vibration, the voluntary movement of the shield plate 4 from the fully closed position can be prevented.

Moreover, when the shield plate 4 is restrained or released from the restraint by operation of the control lever 52, the abutment projection 61 and the locking claw 52*d* are merely put into and out of abutment against each other and cannot rub each other. Therefore, even if the abutment projection 61 and the locking claw 52*d* cannot be worn due to the use of the control lever for a long term and hence, the restraint of the shield plate 4 and the release thereof can be always carried out properly.

Furthermore, since the abutment projection 61 is formed on the inner surface of the shield plate 4 integrally with the toothed wall 38 of the click stop mechanism 39, the abutment projection 61 is reinforced effectively by the relatively large toothed wall 38, whereby the restraint strength of the shield plate 4 restrained in the fully closed position can be enhanced.

When the shield plate 4 is in the opened state, if the control lever 52 is first set in the locking position B and the shield plate 4 is then turned to the fully closed position, the abutment projection 61 can push the slant 62 at the upper portion of the locking claw 52*d* to return the control lever 52 to the neutral position N. Therefore, the shield plate 4 can be reliably brought into the fully closed state without being obstructed by the locking claw 52*d*. Thereafter, if the control lever 52 is set again in the locking position B, the shield plate 4 is restrained in the fully closed position, as described above.

Although the embodiment of the present invention has been described in detail, it will be understood that the present invention is not limited to the above-described embodiment, and various modifications in design may be made without departing from the spirit and scope of the invention defined in the claims.

What is claimed is:

1. A system for controlling a shield plate in a helmet, comprising a click stop mechanism mounted between a cap body and a shield plate pivotally supported on said cap body, said mechanism being capable of retaining said shield plate in a fully closed position, a fully opened position and a plurality of intermediate opened positions; and a control lever pivotally supported on said cap body and capable of being turned between a neutral position in which the full closing of said cap body is permitted, and a slightly opening position in which said shield plate in said fully closed position is pushed up and opened at a very small opening degree;

wherein said control lever has a locking position permitting said control lever to turn from the neutral position in a direction opposite from the slightly opening position;

wherein said shield plate has an abutment projection formed on its inner surface; and wherein said control lever has a locking claw adapted to be put into abutment against a front surface of said abutment projection to inhibit the opening of said shield plate upon turning said control lever to the locking position when said shield plate is in the fully closed position.

2. A system for controlling a shield plate in a helmet according to claim 1, wherein said locking claw has a slant formed thereon so that when said control lever is in the locking position, if said shield plate is turned from an opened position to the fully closed position, said slant is pushed by said abutment projection to turn said control lever to the neutral position.

3. A system for controlling a shield plate in a helmet according to claim 1 or 2, wherein said abutment projection is integrally connected to a toothed wall of said click stop mechanism, said toothed wall having click teeth formed on the inner surface of said shield plate.

* * * * *